US005697513A

United States Patent [19]

Molodyi

[11] Patent Number: 5,697,513

[45] Date of Patent: Dec. 16, 1997

[54] GASKET FOR SEALING MATERIAL STORAGE DRUM

[76] Inventor: Vadim A. Molodyi, 116 Fox Chase Dr. South, Oswego, Ill. 60543

[21] Appl. No.: 719,782

[22] Filed: Sep. 25, 1996

[51] Int. Cl.[6] ..... B65D 45/32; F16J 15/00

[52] U.S. Cl. ..... 220/320; 220/686; 215/275; 277/101

[58] Field of Search ..... 220/320, 321, 220/614, 681, 686; 215/275; 277/101

[56] References Cited

U.S. PATENT DOCUMENTS

| | | | |
|---|---|---|---|
| 2,117,807 | 5/1938 | Jesser | 220/320 |
| 2,324,332 | 7/1943 | Stoddard | 220/614 |
| 3,204,811 | 9/1965 | Fine | 220/320 |
| 3,346,139 | 10/1967 | Armstrong, Jr. | 220/320 |
| 4,651,892 | 3/1987 | Boersma | 220/320 |
| 5,261,677 | 11/1993 | Gotoh et al. | 277/207 R |

*Primary Examiner*—Daniel G. DePumpo

*Attorney, Agent, or Firm*—Charles F. Lind

[57] ABSTRACT

The disclosed storage drum gasket is of annular configuration, substantially symmetrical in cross-section and having inner and outer faces, with an enlarged substantially arrowhead shaped nub or protrusion running centrally around the outer face of the gasket. The gasket is elastic, allowing its inner face to be fitted over the drum rim and the nub to be generally centered on the outer side of the drum rim. Thus, positioning a drum cover over the drum top opening will fit a free edge of the cover lip against the gasket near the neck of the arrowhead. Further, tightening a locking ring onto the drum rim-cover lip will compress the gasket at the nub against both sides of the cover lip at the edge, and immediately adjacent thereto against the drum rim, in the annular multiple sealing regions generally centered relative to the drum rim and locking ring. Other interface sealing regions conventionally between the cover lip and drum rim will also still exist, improving the drum sealing capacity with the improved gasket. The gasket might be particularly effective against leakage incidental with deformation of the drum-cover structures.

6 Claims, 2 Drawing Sheets

GASKET FOR SEALING MATERIAL STORAGE DRUM

BACKGROUND OF THE INVENTION

Material storage drums conventionally are comprised of a bottom wall and an upstanding cylindrical side wall terminating at an upper curled edge or rim that defines a top drum opening, a cover that can be positioned over the rim across the top opening to close the drum, and a locking ring that can be secured over both the cover and rim for holding the drum closed. A gasket of a somewhat elastic and deformable elastomer material (such as a rubber or plastic) will typically be used between the structural drum rim and cover components for sealing the closed drum and stored material therein against leakage, contamination, etc.

Commonly known drum sealing gaskets are of a relatively thin web or strip like configuration, formed as an endless ring, that is laid over the drum rim and then trapped thereagainst by and between the cover as it is closed onto the rim. Sealing regions are established along the cooperating interfaces between each side or face of the gasket and the somewhat broad generally flush adjacent faces of the structural drum rim and cover components, and the locking ring mechanically forces these structural components together to compress the gasket at these sealing regions for establishing a reliable even liquid-tight seal for preventing leakage of material contained under high pressures.

Other known sealing systems have been available, where in each the gasket used had a wider web or strip with one edge thereof being shaped as an enlarged nub sized to fit against the outside of the drum wall spaced from and below the drum rim, and this enlarged nub was engaged by the locking ring and squeezed tightly against the drum wall for creating an annular sealing region independent of the cooperating interface rim-cover sealing regions mentioned above. While these sealing systems with the multiple sealing regions should offer improved sealing characteristics, such systems have received little industry acceptance and use except for containing dangerous or hazardous materials. This reserved use might be due to the reality that one of the systems needs a specially formed locking ring and that all of the systems not only need the special gasket but also require the practice of more complicated assembly steps due to the asymmetrical shape of the gasket which fits in only one accepted orientation on the drum rim.

Of further interest in evaluating any sealing system is how well it stands up over time during its needed storage duration and its normal transportation and storage use patterns, that could include potentially wide temperature swings and rough handling (including tipping, dropping or denting of the drum). Under such conditions, mechanical distortions or bulging of the structural components at or near the sealing regions can occur to reduce gasket compression along any localized path across a sealing region, reducing or destroying the sealing integrity via this path.

The above sealing systems and gaskets are particularly prone to such leakage problems, as each sealing region is established by gasket compression between two adjacent structural components, and its sealing capacity can be reduced or eliminated by even minor deformations, mechanical distortions or bulging of such adjacent structural components. Moreover, although multiple sealing regions are provided that appear to be in a serial arrangement, the same minor deformations, mechanical distortions or bulging of such adjacent structural components can frequently cause sufficient failure of each sealing region so that even the cumulative sealing of all regions proves inadequate to preclude material leakage.

SUMMARY OF THE INVENTION

This invention relates to and an object of this invention is to provide an improved gasket design that can be used with conventional material storage drums, closing covers and locking rings for establishing a reliable liquid-tight drum seal, and that further is particularly effective in withstanding loss of such sealing ability caused by mechanical distortions or bulging of the structural components at or near the sealing regions.

A more specific related object of this invention is to provide a gasket that establishes multiple spaced regions of gasket compression and/or sealing, and specifically including multiple sealing regions at and around the lip edge of the cover.

Another related object of this invention is to provide a gasket that establishes multiple spaced regions of sealing, made effective by localized high density gasket compression between and by adjacent structural drum-rim-locking ring components, whereby deformations, mechanical distortions or bulging of such adjacent structural components does not reduce gasket compression sufficiently to allow material leakage.

Yet another object of this invention is to provide a gasket that is symmetrical in cross-section, suited to be easily assembled onto the drum without regard to maintaining any specific orientation during assembly of asymmetrical gasket configurations, as required with many prior art gaskets.

BRIEF DESCRIPTION OF THE DRAWINGS

These and other objects, features or advantages of the invention will be more fully understood and appreciated after reviewing the following specification which includes as a part thereof the accompanying drawings, wherein.

Figure 1:
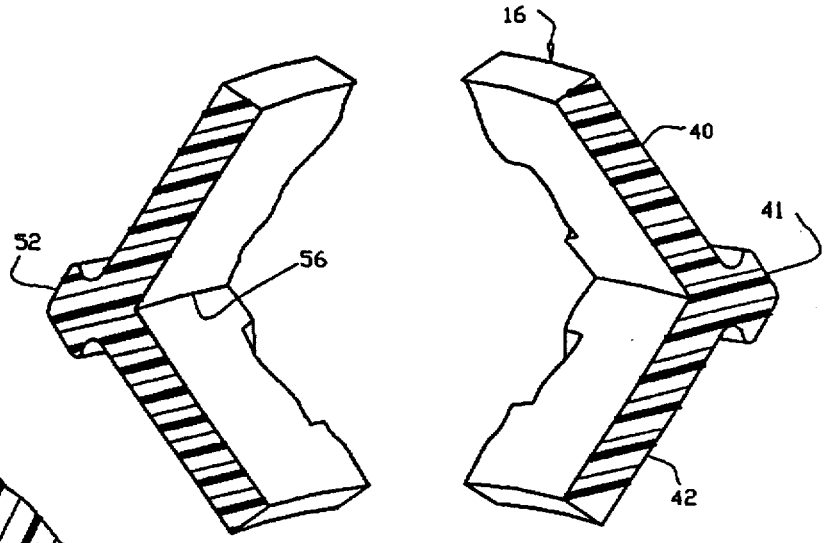
FIG. 1 is a longitudinal center sectional view of an annular gasket incorporating an embodiment of the subject invention.

While the enlarged drawings illustrate both the construction and probable fits of the structural and gasket components, the drawings are not to an exact scale or proportional and might be exaggerated to better illustrate the operation of the invention.

DETAILED DESCRIPTION OF A PREFERRED EMBODIMENT OF THE INVENTION

To illustrate and appreciate this invention, a conventional material storage drum and its closure components will first be described. The drum 10 generally has a bottom wall (not shown) and a substantially cylindrical side wall 12 upstanding therefrom and terminating at an upper curled edge or rim 14 defining a drum top opening; and the closure components consist of an annular gasket 16 that can be positioned over the rim 14, a cover 20 that can be positioned over the rim 14 and gasket 16, and a split locking ring 22 that can be fitted over the cover and rim and tightened for holding the components together in sealing the drum.

The drum rim 14 would typically have a hollow generally circular cross-section, presenting thereon a smooth rounded exterior face having upper and lower portions 24 and 26 respectively meeting at an annular region 28 that defines a plane (identified as line 30) extended perpendicular to the tangent lines at the annular region and across the drum opening.

The cover 20 would typically have a generally flat central portion 32 that would traverse the drum opening and an annular outer lip 34 shaped to generally complement the upper rim face 24, with lower lip edge 36 lining up generally at or just slightly above the tangent region 28 or transverse plane 30.

The locking ring 22 would have a C-shaped cross-section, with a central curved portion 37 sized to generally complement the underlying adjacent rim and cover lip and with diverging straight upper and lower ends 38 that respectively overlie the cover lip 34 and underlie the drum rim lower face 26. Tightening means (not shown) are included on the split locking ring effective to reduce the diameter of the ring, squeezing and holding the cover axially tight against the drum rim and compressing the interposed gasket 16 for establishing a liquid-tight seal.

Figure 2:
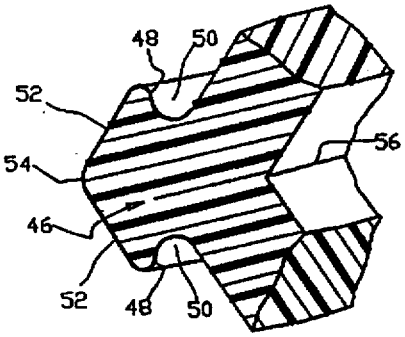
FIG. 2 is an enlargement of part of FIG. 1, illustrating a protrusion portion of the gasket.

The improved gasket 16 of FIGS. 1 and 2 is an endless ring or annular body configured as a strip-like thin web defining inner and outer faces. The body web has adjacent portions 40, 41 and 42 of different thickness between the inner and outer faces, the end portions 40 and 42 having lesser thicknesses than the central portion 41. A neck connects an enlarged protrusion 46 having shoulders 48 thereon off of the central web portion 41, with each protrusion shoulder 48 being opposed to and spaced from the outer face of the adjacent end portion 40 or 42 immediately adjacent the neck, providing thereby opposed endwardly open recesses 50.

The gasket preferably has a symmetrical cross-section, with the thin end portions 40 and 42 being of generally uniform thickness. The central portion 41, outwardly of the thickness of the end portions, is shaped somewhat as an arrowhead, comprised as the neck, enlarged protrusion 46 and shoulders 48, with converging outer protrusion faces 52 meeting at a rounded but otherwise substantially pointed exterior annular ring area 54.

The web body end portions 40 and 42 are shown in cross-section as being straight, which as the real three-dimensional gasket would be conical, and meeting across an inside rounded corner 56 aligned with and at the central portion.

The gasket 16 could be economically formed, as by extruding a continuous web with the illustrated cross-section, cutting the web to desired lengths, and joining the severed ends of the cut web by bonding, vulcanization or the like.

Figure 3:
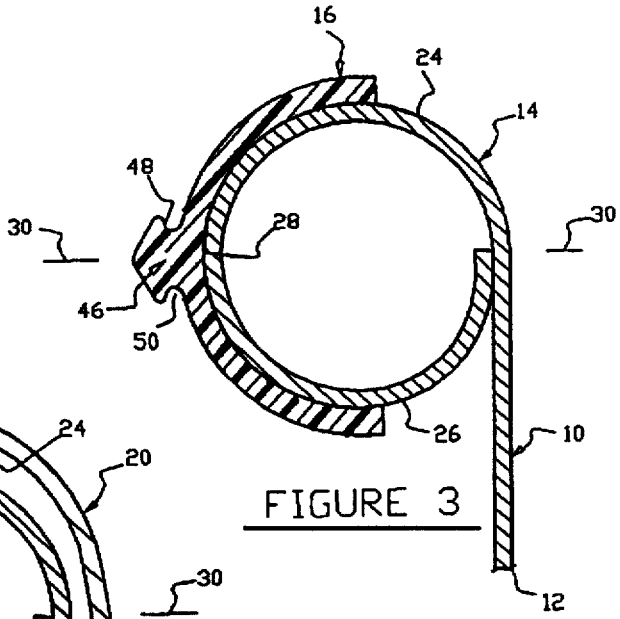
FIG. 3 is a longitudinal center sectional view of a left side of an typical material storage drum at its rim and top opening, illustrating the gasket positioned on the drum but without any cover and locking ring.
Figure 4:
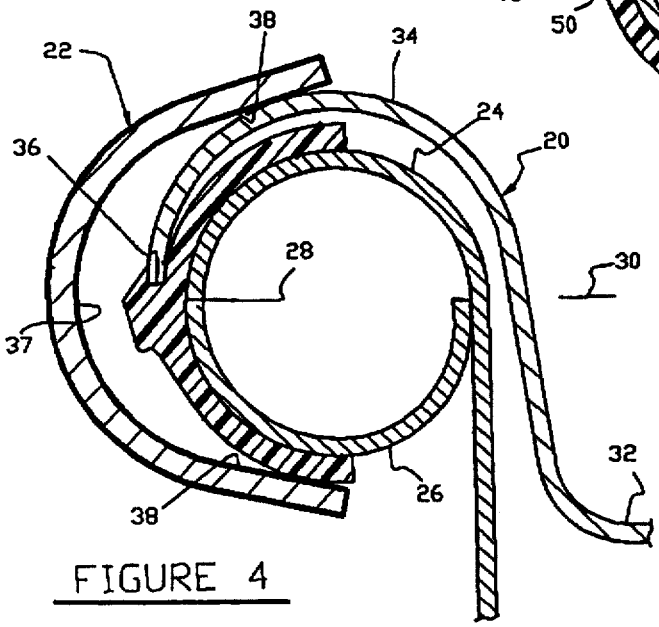
FIG. 4 is a sectional view similar to FIG. 3, except illustrating a cover and locking ring positioned on the drum, but not yet locked.
Figure 5:
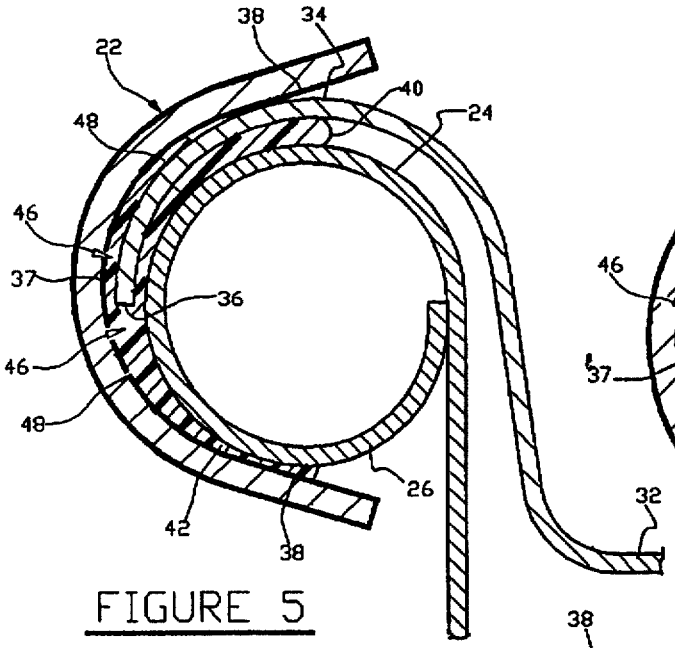
FIG. 5 is a sectional view similar to FIG. 4, except illustrating the locking ring tightened to close and seal the drum.

The gasket 16 can preferably be sized to be fitted, with slight stretching, over the drum rim 14, with its inner face wide enough to position the illustrated upper end portion 40 over about half or more of the upper rim face 24 and the lower end portion 42 over the lower rim face 26, and with the upper recess 50 opened upwardly and aligned just above the rim center plane 30. The flexibility of the gasket will allow the inner gasket face to conform closely to and lie substantially flush against the upper and lower rim faces, as illustrated in FIG. 3. With the gasket made symmetrical in cross-section, it can be easily fitted onto the drum without regard to maintaining a specific "this side up" or the like orientation during assembly.

When the lip 34 of the cover 20 is fitted onto the drum rim 14, it will overlie only the upper end portion 40 of the gasket, and its free edge 36 will fit into the upper recess 50 and possibly butt against the gasket neck, lining up generally at or above the rim plane 30. The cover 20 could be tapped reasonably tight over the gasket and onto the rim, by hand or with a mallet. The locking ring 22 when operatively positioned over the rim and cover will have its upper and lower end portions 38 respectively overlying the cover lip 34 and the lower end portion 42 of the gasket and the lower rim face 26.

When tightened, the locking ring 22 will bias the cover axially against the drum rim, and the gasket portions 40 and 42 interposed therebetween are compressed across each's thickness, for establishing in the same manner what has been the conventional lapped sealing regions between the drum and cover. Moreover, the tightened locking ring 22 along its curved center face 37 engages and compresses the protrusion 46 against the underlying cover lip and drum rim, establishing highly compressed gasket sealing regions proximate the cover lip edge 36.

Specifically, the upper portion of the protrusion 46 via the shoulder 48 and the underlying gasket web body of the upper end portion 40 establish dual sealing regions against both sides of the cover lip edge 36 and adds indirectly to the gasket compression of one part of the previously mentioned lapped sealing region of the inner face against the drum rim face, and the lower portion of the protrusion 46 via the neck and the remainder of the central body web portion 41 adds directly to the gasket compression of an adjacent part of the previously mentioned lapped sealing region of the inner face against the drum rim face, generally proximate the annular tangent region 28.

The gasket 16 will thus provide multiple highly compressed sealing regions, along the inner gasket faces against the drum rim faces 24 and 26, and along the outer gasket faces against both sides of the cover adjacent the lip edge 36. These sealing regions effectively isolate and/or seal the drum interior from the exterior. Further, the resiliency of the gasket material will allow the localized super compressed regions of the gasket provided by and between structural components to expand slightly, should relative structural component deformation occur to relax the gasket compression, thereby retaining gasket compression across the multiple sealed potential leakage paths, likely sufficient in fact to keep the drum seal reliable and sound.

Of great significance also, in order to have structural deformation that would reduce the effectiveness of the drum seal, such deformation must occur between and/or relative to the multiple components compressing the interposed gasket. With the subject gasket configuration, such deformation is less likely to occur compared to the conventional gaskets discussed above.

Figure 7:
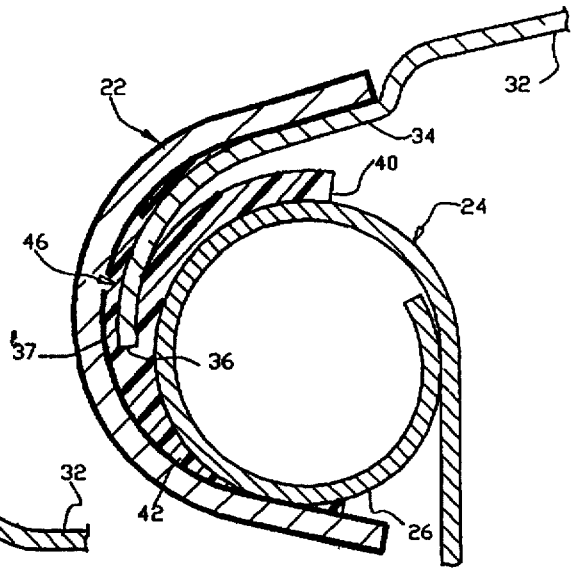
FIG. 7 is a view similar to FIG. 5, except showing the adjacent structural components as such might be deformed by excessive internal pressure within the drum, and how the gasket might remain locally compressed for effectively retaining a sound drum seal.
Figure 6:
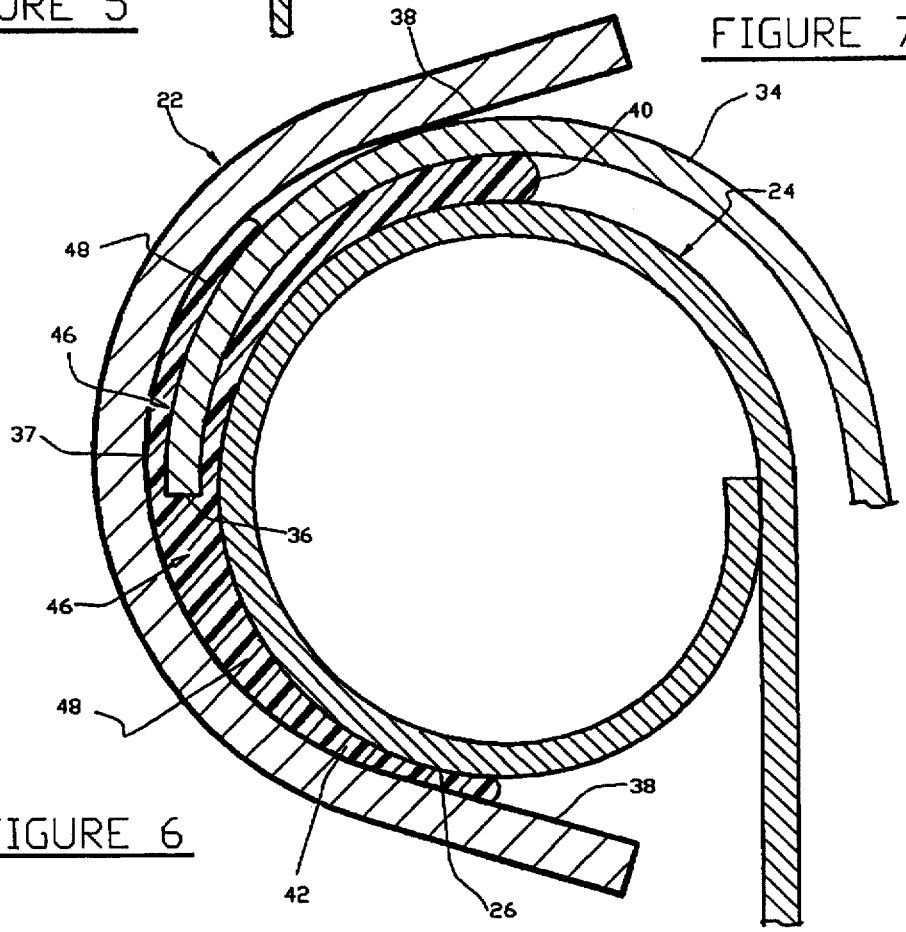
FIG. 6 is an enlargement of the sealed drum of FIG. 5 in the vicinity of the gasket protrusion of FIG. 2, illustrating it as it might be operatively compressed by and between the adjacent structural components.

For example, deformation forces could be generated by thermal expansion of the contained fluids and/or during handling including transporting such drums, as when being stacked or even dropped. Typical over-pressure drum deformation configurations are illustrated in FIG. 7, where the cover 20 is bulged outwardly and the locking ring 22 at the straight ends 38 are partially wedged apart and opened, and the drum rim 14 is even partially collapsed. However, the locking ring 22 will have great strength against radial expansion and resist the outward bias of the drum rim proximate the annular tangent region 28 and cover lip edge 36, and these structural components in this general region will act together in resisting being deformed from most causes. Further, bending moments attributed to cover bulging will be minimized at the cover lip edge. Thus, any relative component deformation affecting the proximate highly compressed gasket sealing regions will thus typically be minimal, thereby only minimally allowing reduced effective drum sealing.

It would be preferred to have the protrusion 46 sized to be compressed to a dense condition, when the drum is closed and sealed by the tightened locking ring, meaning that it might be reduced in volume to be perhaps between only 0.2–0.5 its original volume. By way of example, a conventional fifty-five gallons capacity storage drum 10 might have the top rim curled to a 0.5" diameter, and the cover lip might be fabricated of sheet steel of possibly 0.037", 0.047" or 0.057" standard thickness, or the like. The improved gasket 16 might have an overall width of between 0.7"–1.2", with each end portion 40, 42 with a web of between 0.25"–0.30" thickness extended to the neck which typically would be at least of a 0.1" width. Each protrusion shoulder 48 can be between 0.1"–0.3" wide, defining the same overlap and approximately recess depth; and the radial neck would slightly exceed the cover lip thickness to easily accept the lip during assembly. The protrusion 46 might project radially between approximately 0.2"–0.3" away from the shoulder, with rounded edges to leave an approximate minimum corner thickness of 0.1" for durability and providing sufficient gasket material for creating super dense compression when the drum is sealed closed.

While a specific embodiment has been illustrated, it will be obvious that minor changes could be made therefrom without departing from the spirit of the invention. Accordingly, the invention is to be determined by the scope of the following claims.

What is claimed is:

1. In combination, a material storage drum including a top opening defined at a curled rim having upper and lower annular faces and an annular transition region therebetween, a gasket comprised as an endless annular thin strip-like web having an inner face suited to be fitted around the drum rim and over the upper annular rim face and transition region, and said gasket also having an enlarged annular protrusion connected by an annular radial neck off of the web from an outer face opposite the inner face and at a location aligned near the transition region with the gasket so fitted on the drum rim, a cover having an annular lip curved to overlie said upper drum rim face and said gasket web when fitted thereon and being operable to close the top opening, and the cover lip having an annular edge adapted to be fitted against the gasket neck and be proximate the protrusion when the cover is simply closed over the drum top opening, and a locking ring suited to overlie the cover lip edge and gasket protrusion and to overlie the portions of both the cover lip and drum rim lower face immediately adjacent to and respectively on upper and lower sides of the protrusion, the locking ring when tightened being operable to compress the gasket and gasket protrusion and deform the protrusion to provide multiple high density sealing regions on both sides of the cover lip proximate the cover lip edge and between the drum rim and the gasket web inner face under the protrusion.

2. A combination according to claim 1, further comprising the protrusion being enlarged in directions both radially in line with and transverse to the neck, and said protrusion including an annular shoulder thereon opposed to and spaced from the outer web side and defining therebetween an annular recess open upwardly and transversely of the neck and adapted to freely receive the annular cover lip for having the lip edge positioned radially between the protrusion and other web face when the cover is initially closed over the drum top opening.

3. A combination according to claim 2, further comprising the annular web extending also beyond the neck and protrusion to provide that the inner face is sized to be fitted around the rim and over both the upper and lower rim faces, and the locking ring overlying and engaging the web positioned over the drum rim lower face and operable when tightened in closing the drum cover to compress the gasket web inner face against both the lower and upper rim faces.

4. A combination according to claim 2, further comprising the annular web being substantially symmetrical about the neck, to allow the gasket to be fitted over the drum rim with either side of the web and protrusion facing upwardly and to have the cover lip edge fit thereagainst when the cover is closed over the drum top opening.

5. A combination according to claim 3, further comprising the annular web being substantially symmetrical about the neck, to allow the gasket to be fitted over the drum rim with either side of the web and protrusion facing upwardly and to have the cover lip edge fit thereagainst when the cover is closed over the drum top opening.

6. A combination according to claim 5, further comprising the neck and protrusion being shaped substantially as an arrowhead in cross-section running annularly around the outer face of the gasket.

* * * * *